US005568837A

United States Patent [19]

Funk

[11] Patent Number: 5,568,837

[45] Date of Patent: Oct. 29, 1996

[54] METHOD OF INSERTING TUBING INTO LIVE WELLS

[76] Inventor: Kelly Funk, 301 Mount Royal Place, Nanaimo, British Columbia, Canada, V9R 6A4

[21] Appl. No.: 495,897

[22] Filed: Jun. 28, 1995

[51] Int. Cl.[6] ..... E21B 23/08

[52] U.S. Cl. ..... 166/383

[58] Field of Search ..... 166/383, 381, 166/380

[56] References Cited

U.S. PATENT DOCUMENTS

| | | | |
|---|---|---|---|
| 3,346,045 | 10/1967 | Knapp et al. | 166/383 X |
| 3,394,760 | 7/1968 | Childers et al. | 166/383 |
| 3,398,794 | 8/1968 | Fox, Jr. | 166/381 |
| 3,464,496 | 9/1969 | Genois et al. | 166/315 |
| 3,467,196 | 9/1969 | Kinsman | 166/383 |
| 3,525,401 | 8/1970 | Hanson et al. | 166/383 |
| 3,999,610 | 12/1976 | Sage et al. | 166/383 |
| 4,384,616 | 5/1983 | Dellinger | 166/381 X |
| 4,844,161 | 7/1989 | Rankin et al. | 166/250 |
| 4,915,178 | 4/1990 | Goldschild | 166/70 X |
| 4,986,361 | 1/1991 | Mueller et al. | 166/381 |
| 5,163,515 | 11/1992 | Tailby et al. | 166/383 |
| 5,311,954 | 5/1994 | Quintana | 175/61 |
| 5,456,317 | 10/1995 | Hood, III et al. | 166/380 X |

*Primary Examiner*—Hoang C. Dang
*Attorney, Agent, or Firm*—Brian M. Long

[57] ABSTRACT

A method of inserting tubing into a live well bore, includes attaching a resilient piston to a lower end of the tubing, lowering the piston into a passage at a well head to locate the piston in a position above a closure which prevents the escape of fluid from the well bore through the passage, sealing the passage around the tubing above the piston and opening a path of communication between the well bore below the closure and a portion of the passage above the piston to equalize the hydraulic pressure above the piston with that below the closure. The closure is then opened and fluid is pumped from a fluid reservoir into the passage above the piston to force the piston and the tubing downwardly in the well bore. Subsequently, the piston and the tubing are allowed to descend under gravity while fluid flows upwardly in the well bore past the piston by deformation of the piston by the pressure of the fluid.

9 Claims, 12 Drawing Sheets

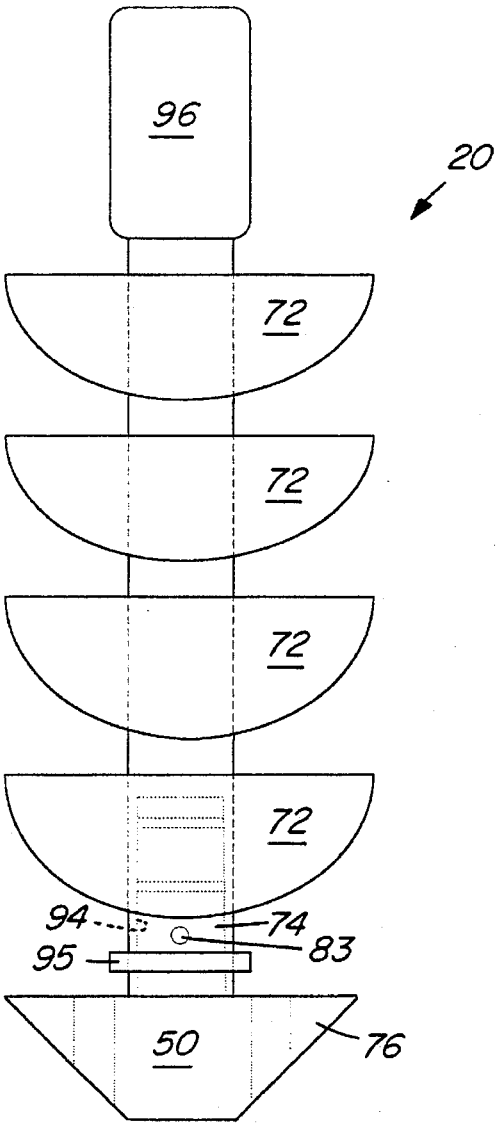
FIG. 8
FIG. 9
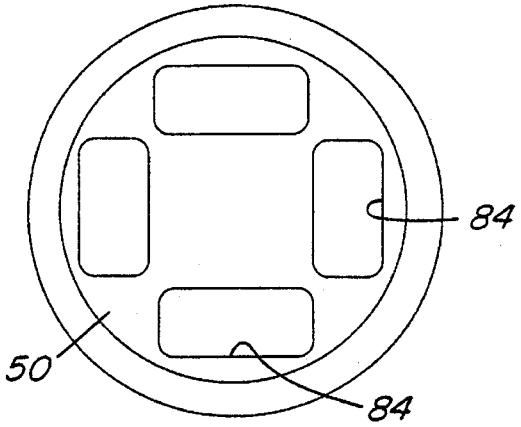
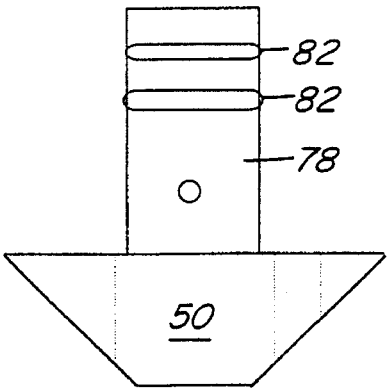
FIG. 10

METHOD OF INSERTING TUBING INTO LIVE WELLS

BACKGROUND OF THE INVENTION

1. Field of the Invention

The present invention relates to methods of and apparatus for inserting tubing into live wells, for example for gas and petroleum extraction.

2. Description of the Prior Art

A conventional method of completing or servicing a well is to keep the well controlled (dead) or in an over-balanced position using different types of fluids. In this way, a hydrostatic pressure is created by a solid column of fluid above a producing zone which is greater than the actual well pressure. This allows a work to be carried out on the well without any immediate danger or inconvenience.

Live well servicing or snubbing is primarily used in gas well applications because of fluid sensitive formations. Thus, it has been long proven that many gas well formations are very sensitive and can be damaged if foreign fluids are introduced and allowed to penetrate their producing zones. A common completion procedure in the oil industry today comprises perforating the zone, with no fluid in the well or in a under-balanced condition, immediately flowing back or unloading any fluid from the well, before the gas pressure equalizes in the casing and allows any fluid to be displaced or injected into the formation, and then snubbing-in a production string of tubing and associated tools.

Existing conventional snubbing techniques are dangerous because it is necessary to deal with the effect of the well pressure over the cross-sectional areas of the tubing and/or the tools which are being injected into the well through a series of blowout preventers.

The actual injecting of tubular goods into the well is achieved using a hydraulic jacking type of assembly with inverted or upside-down slips mounted in it to prevent the tubing from coming back or literally blowing out of the well. A general rule of thumb would be that 3000 PSI surface pressure well against the cross-sectional area of 2⅜ inch production tubing will force 3000 feet of pipe weighing 4.7 lbs./foot out of the well if allowed to do so. In reverse, 3000 feet of tubing would have to be snubbed into the well to reach a point where it could be lowered into the well using its own weight (pipe heavy).

All operations are performed manually from within a small work platform that sits directly on top of the well. This has major potential consequences in the event of human error or mechanical failure. Because of the increased production potential that a well has when it has not been damaged by allowing any fluid to penetrate the zone, oil companies have unwillingly paid the brunt of inflated snubbing costs required to persuade personnel to work under these dangerous conditions.

Many companies are therefore actively looking for a viable, safe and economical alternative way of completing and servicing wells without the risk of formation damage and also without high cost and potential danger of snubbing. This is particularly true in the case of in critical sour (H2S) well applications.

BRIEF SUMMARY OF THE INVENTION

It is accordingly and object of the present invention to provide a novel and advantageous method of inserting tubing with live wells which replaces conventional snubbing for many applications by providing a safer, less expensive, more controlled procedure for inserting tubular goods and downhole tools into well bores while maintaining well pressure, and also while preventing foreign fluid from penetrating the producing zone of the well bores.

According to the present invention, a method of inserting tubing into a live well comprises attaching a resilient piston to the lower end of the tubing, lowering the piston into a passage extending through a snubbing blow-out preventer stack installed on a well head to locate the piston in a position above a closure which prevents the escape of gas or liquid from the well bore and opening a path of communication between the well bore below the closure and a portion of the passage above the piston, so as to equalize the pressure above the piston with that below the closure. The closure is then opened, and the piston is gripped and forced downwardly into the well bore and fluid is subsequently pumped into the passage above the piston to force the piston and the tubing further downwardly into the well bore. When the weight of tubing is sufficient, the tubing is allowed to descend further under gravity, while fluid from the well bore escapes upwardly past the piston by deforming the piston so that the fluid can flow between the piston and the casing of the well bore.

BRIEF DESCRIPTION OF THE DRAWINGS

The invention will be more readily understood from the following more detailed description of a preferred embodiment thereof given, by way of example, with reference to the accompanying drawings, in which:

FIG. 8 shows in greater detail a piston cup assembly employed in the method shown in the FIGS. 1 through 5;

FIGS. 9 and 10 show an underneath view and a view inside elevation, respectively, of a gauge ring forming part of the piston cup assembly of FIG. 8;

DESCRIPTION OF THE PREFERRED EMBODIMENT

Figure 1:
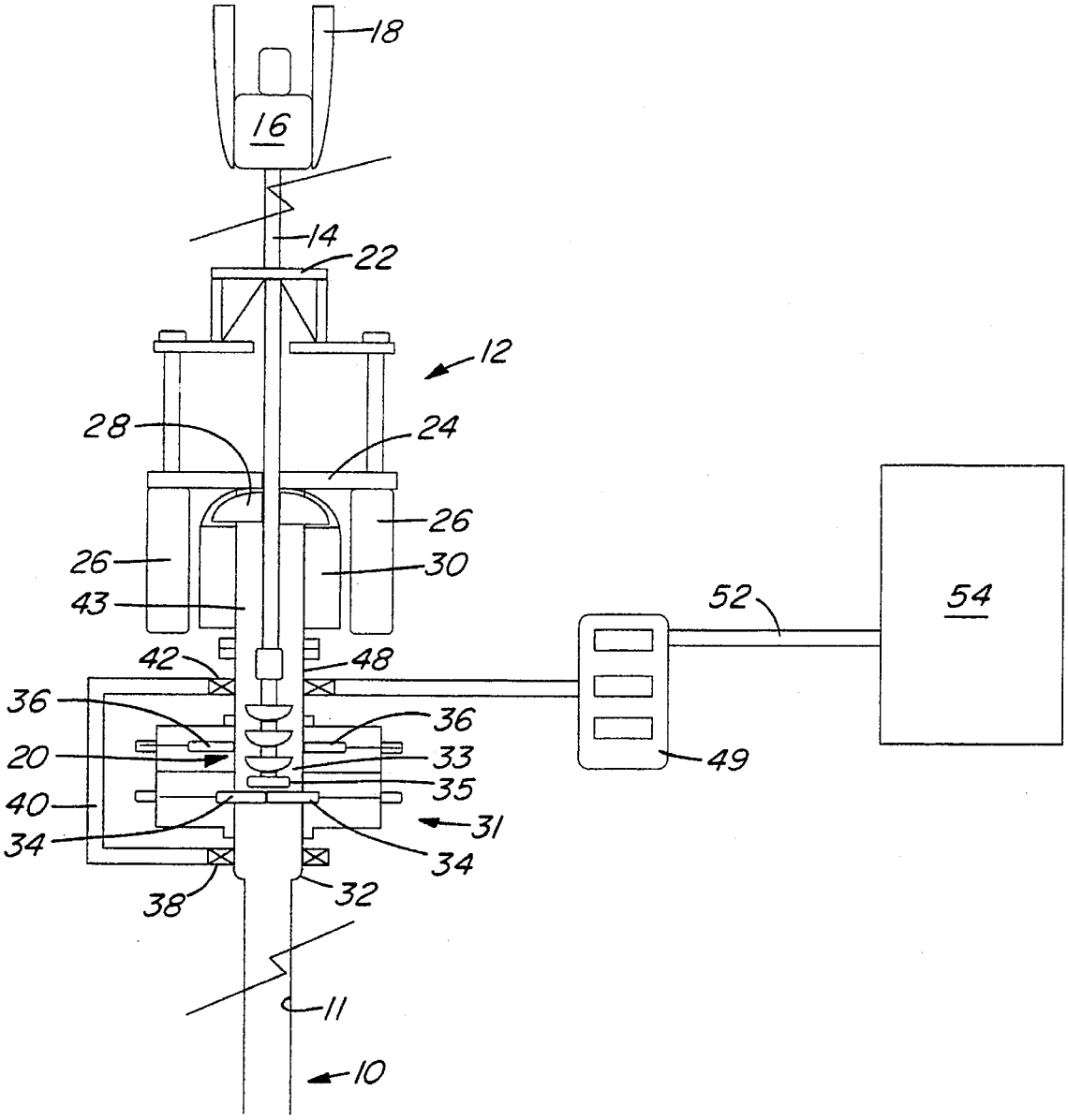
FIGS. 1 through 7 show diagrammatic views in vertical cross-section through a well head and bore, showing successive steps in a method of inserting tubing into the well bore.

As shown in FIG. 1, a well bore indicated generally by reference numeral 10 and having a casing 11 is provided with well head equipment indicated generally by reference numeral 12, through which tubing 14 is being inserted. The tubing 14 is supported by elevators 16 attached to bails suspended, in known manner, from a pulley mechanism (not shown) of a conventional hoist (not shown).

The tubing 14 carries, at its lower end, a piston in the form of a piston cup assembly indicated generally by reference numeral 20.

The well head equipment 12 includes, from the top down, snubbing slips 22 for gripping the tubing 14, the snubbing slips 22, being mounted on a base plate 24 complete with a hydraulic jacking assembly 26 so that the slips 22 can be closed on the tubing 14 and the tubing 14 and/or the slips 22 can be raised or lowered. The base plate 24 is mounted to the top of an annular blow out preventer 30, which is mounted to an equalizing spool 48 mounted to a single gate blow-out preventer 30, which may optionally be provided with stripping pipe rams (not shown). The blow-out preventer has a top 28 which closes the upper end of a passage 33, the tubing 14 extending through the top 28. The blow-out preventer 30 is mounted on double-gate blow-out indicated generally by reference numeral 31, which includes pipe rams 36 and blind rams 34 and the double-gate blow-our preventer 31 is directly connected to the well head.

As will be apparent to those skilled in the art, the configuration and combination of the blow-out preventers may vary from well to well, depending on the well, the tools and application in which they are being used. For simplicity, the configuration of FIG. 1 is considered to be standard for the most basic well applications.

Below the base plate 24, the tubing 14 extends through the annular blow-out preventer, a top 28 of which closes the upper end of a casing 31 defining part of a passage 33 communicating with the well bore 10.

As shown in FIG. 1, the blow-out preventer 31 acts as a closure for closing an upper end of a casing 35 which includes a casing bowl 32.

The passage 33 extends through the equalizing spool 48 and a casing 35 which has a casing bowl 32 joined to the well bore casing 11. The passage 33 is connected at its lower end, below the blind rams 34, through valves 38 with an equalizing duct 40, which extends from the valves 38 to an equalizer valve 42, through which the equalizing duct 40 can communicate with a portion 43 of the passage 33 above the blind rams 34 and the piston cup assembly 20. This passage portion 43 is connected through a bleed-off valve 44 and a duct 46 to a pump 49, which in turn is connected by a duct 52 to a fluid reservoir tank 54.

For inserting the tubing 14 into the well bore 10, the equalizing spool 48 and the snubbing slips 22 with their piston and cylinder devices 26, and the blow-out preventers 30 and 31 are installed on the well head with the snubbing slips 22 in the "pipe light" position in which they are shown in FIG. 1.

The equalizing line 40 is then connected through the valves 38 and 42 to the well bore 10 and the passage portion 43, with the valves 38 and 42 closed, and the piston cup assembly 20 is secured to the lower end of the tubing 14, together with a gauge ring and plugging device 50 at the lower end of the piston cup assembly 20.

With the blind rams 34 closed, the piston cup assembly 20 is then lowered to the position in which it is shown in FIG. 1, i.e. to a location immediately above the closed blind rams 34.

The piston and cylinder devices 26 are then extended to raise the snubbing slips 22 into the position in which they are shown in FIG. 1, the snubbing slips 22 are closed to grip the tubing 40 and the blow-out preventer 30 is closed to seal-off the well bore 10, so that the top 28 seals the passage 33 to the tubing 14.

Figure 3:
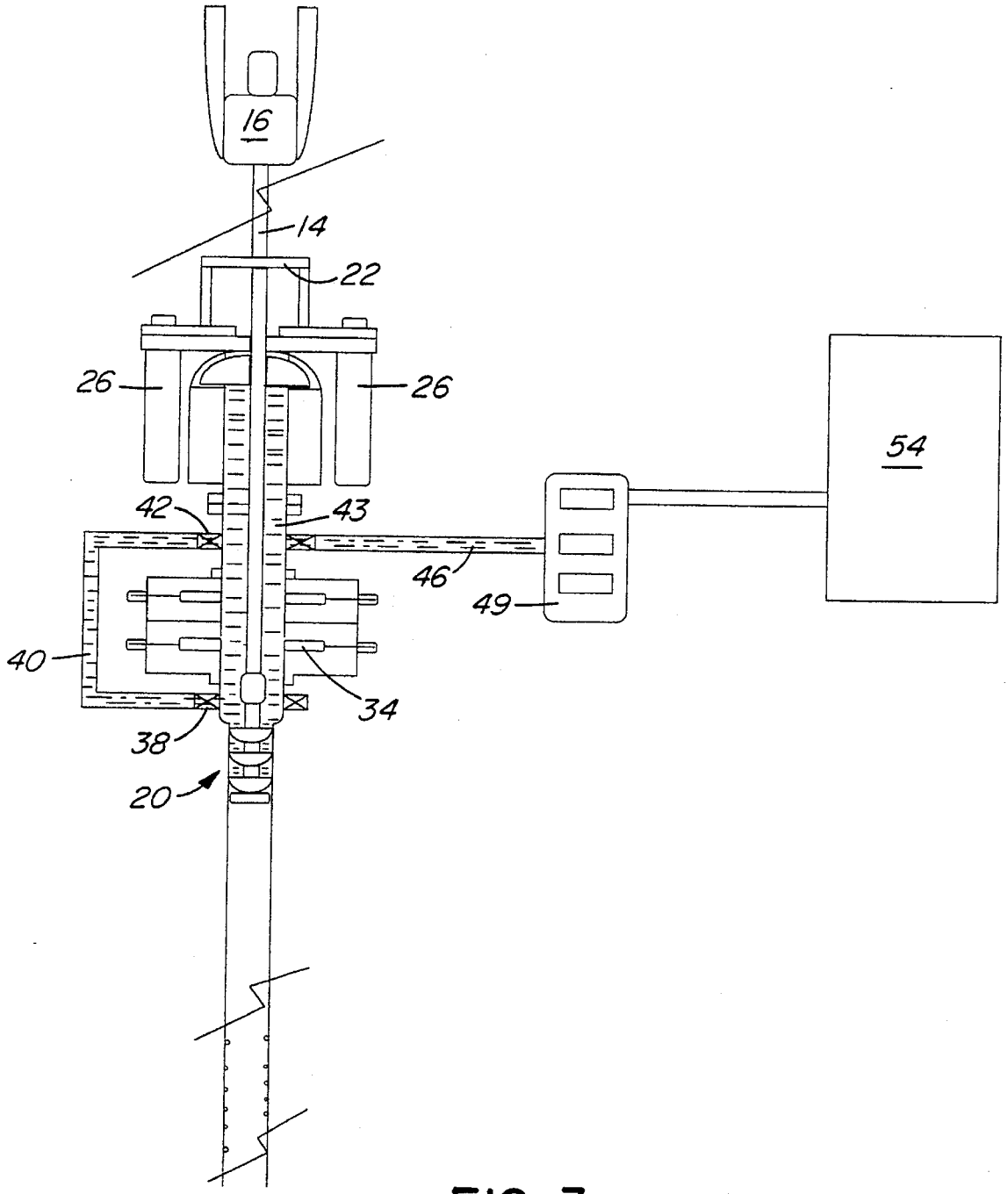

By opening the valves 38 and 42, and thereby providing communication between the well bore 10 and the portion 43 of the passage above the piston cup assembly 20, the pressures above and below the piston cup assembly 20 are equalized, as illustrated in FIG. 3.

Figure 2:
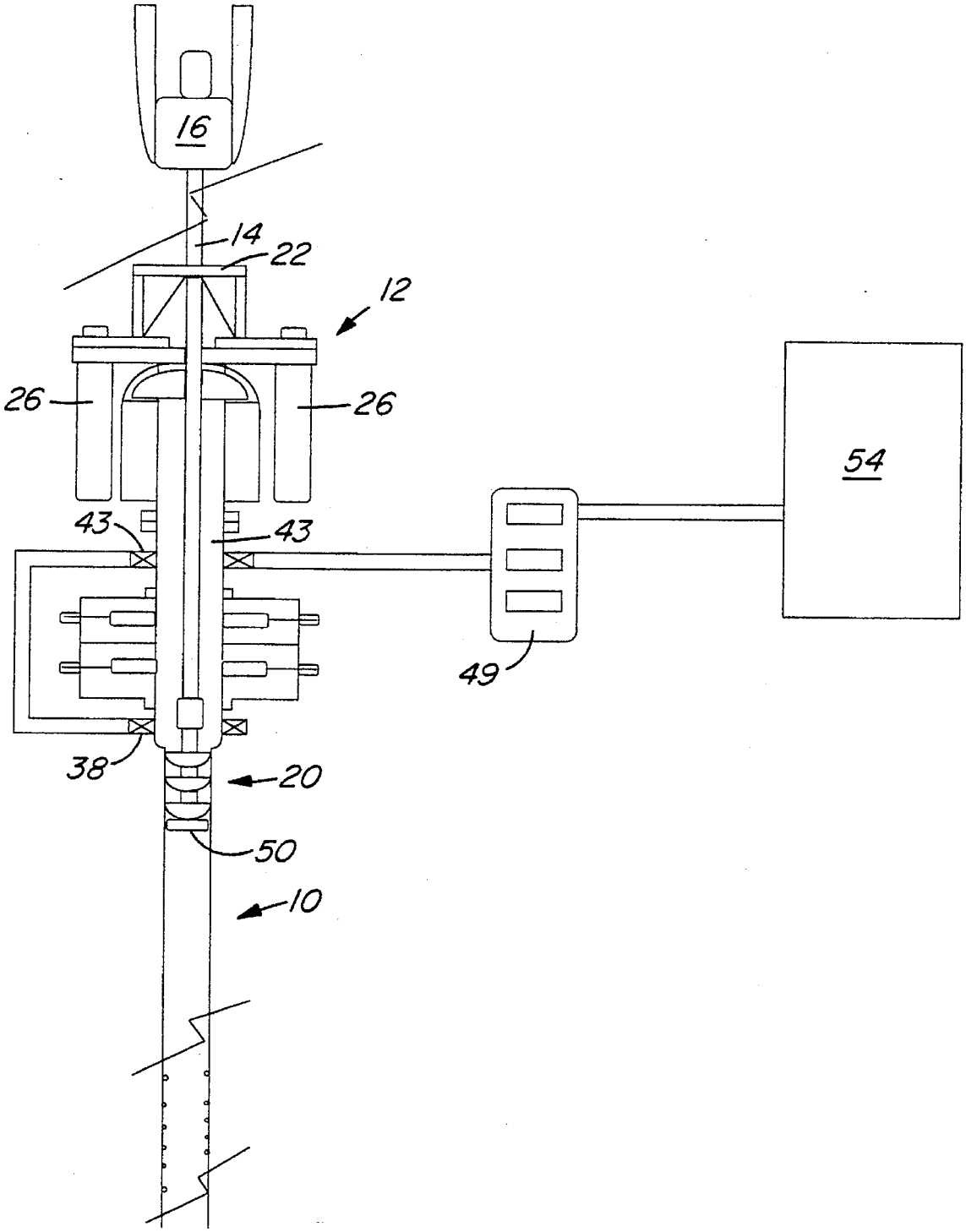

The blind rams 34 are then opened, and the piston and cylinder devices 26 are contracted to displace the piston cup assembly 20 downwardly from the casing bowl 32 to a location within the top of the well bore casing 11, as illustrated in FIG. 2.

The equalizer valve 42 is then closed, and the pump 49 is operated to increase the pressure in the duct 46 until this pressure equals the pressure in the passage portion 43. The valve 44 is then opened, and the pump 49 is used to increase the pressure in the passage portion 43 to overcome the friction of the annular blow-out preventer 30 and the well pressure in the well bore 10 and, thereby, to force the piston cup assembly downwardly into the well bore 10.

It is preferable to create enough string weight at the elevators 16 to smoothly lower the piston cup assembly 20 at desirable rate of speed, so that the elevators 16, when lowered, come down at the same speed as the tubing 14 is being forced into the well.

By means of the bleed off valve 44, any gas head in the passage 33 above the piston cup assembly 20 is bled off, while the desired pump pressure is maintained in the duct 46 and the passage portion 43, until a steady stream of fluid is bled off by the valve 44, and the valve 44 is then closed.

While the tubing 14 is still suspended by the elevators 16, the pump pressure in the passage portion 43 is increased or decreased, as necessary, until the hoist comprising the elevators 16 has a string weight of e.g. 2,000 to 3,000 lbs. showing on its weight indicator (not shown).

Figure 4:
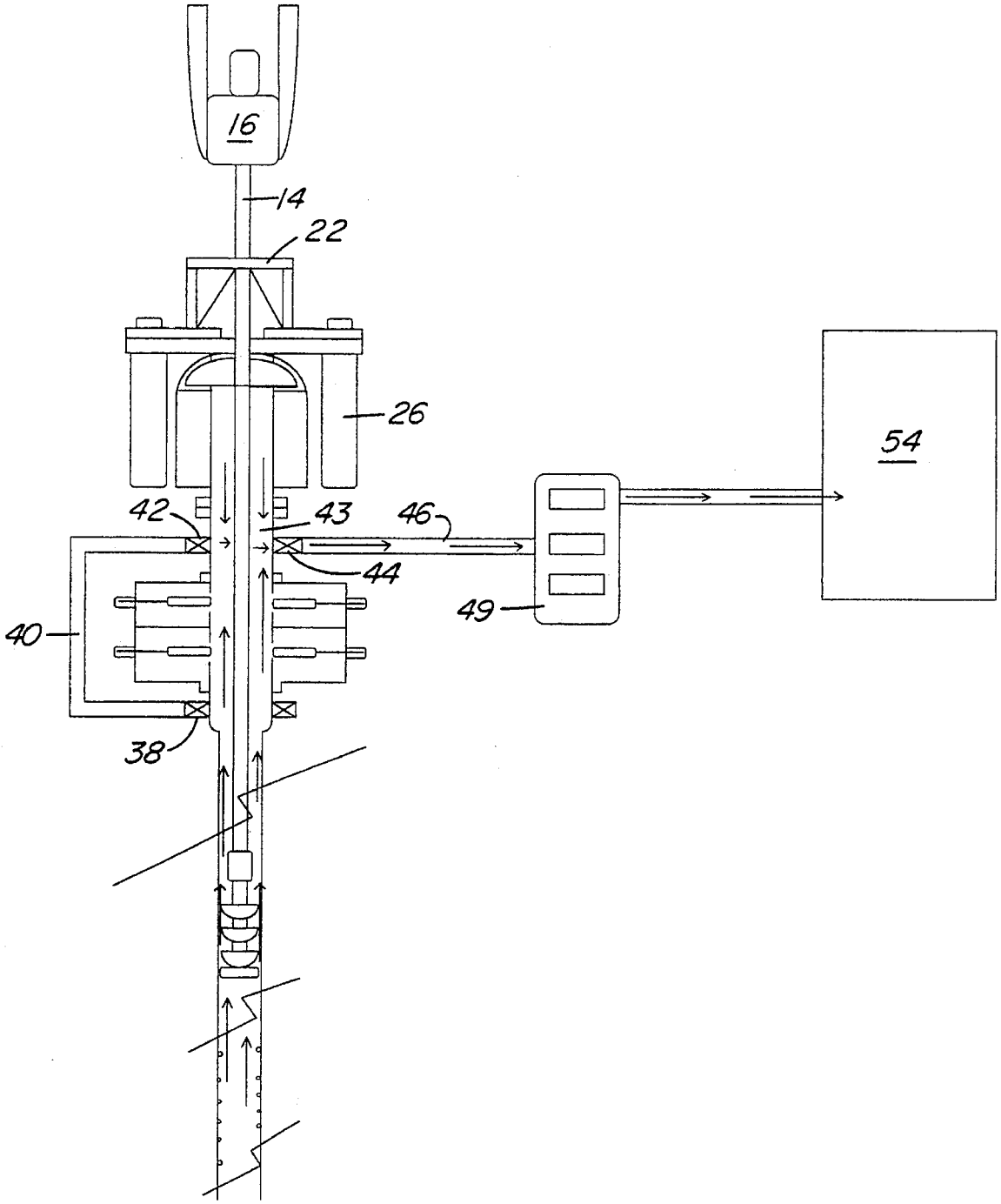

The snubbing slips 22 are then opened, and a constant pressure is maintained above the piston cup assembly 20 by means of the pump 49, while the tubing 14 is lowered by the elevators 16, as illustrated in FIG. 4.

While a constant pressure is maintained above the piston cup assembly 20, the tubing is lowered into the well bore 10 to a calculated depth, at which it is pipe heavy, i.e. at which the weight of the tubing is sufficient to overcome the pressure of the gas or liquid in the well bore 10.

The snubbing slips 22 are then again closed, and fluid is then bled from the passage portion 43 back to the reservoir tank 54.

Fluid under pressure at the underside of the piston cup assembly 20 can then flow past the piston cup assembly 20 as illustrated in FIG. 4 to discharge fluid from the passage 33 above the piston cup assembly 20, so that equalized pressures prevail above and below the piston cup assembly 20. Tubing 14 is therefore in a heavy position under its own string weight.

Figure 5:
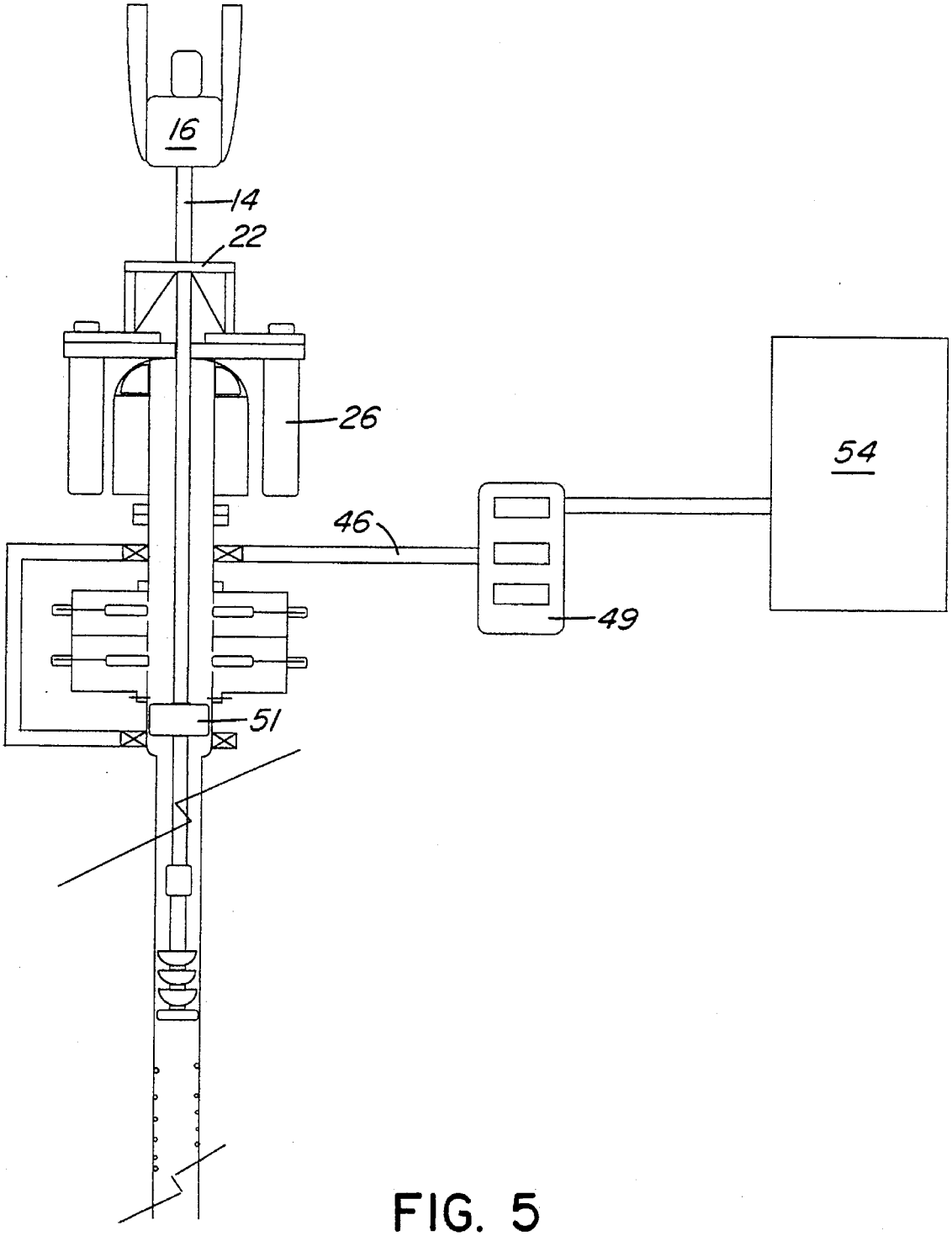

The snubbing slips 22 are then opened to release the tubing 14 and to allow the elevators 16 to continue to lower the tubing into the well bore 10 to a desired depth, while maintaining the pressure in the well bore 10, as illustrated in FIG. 5.

Figure 6:
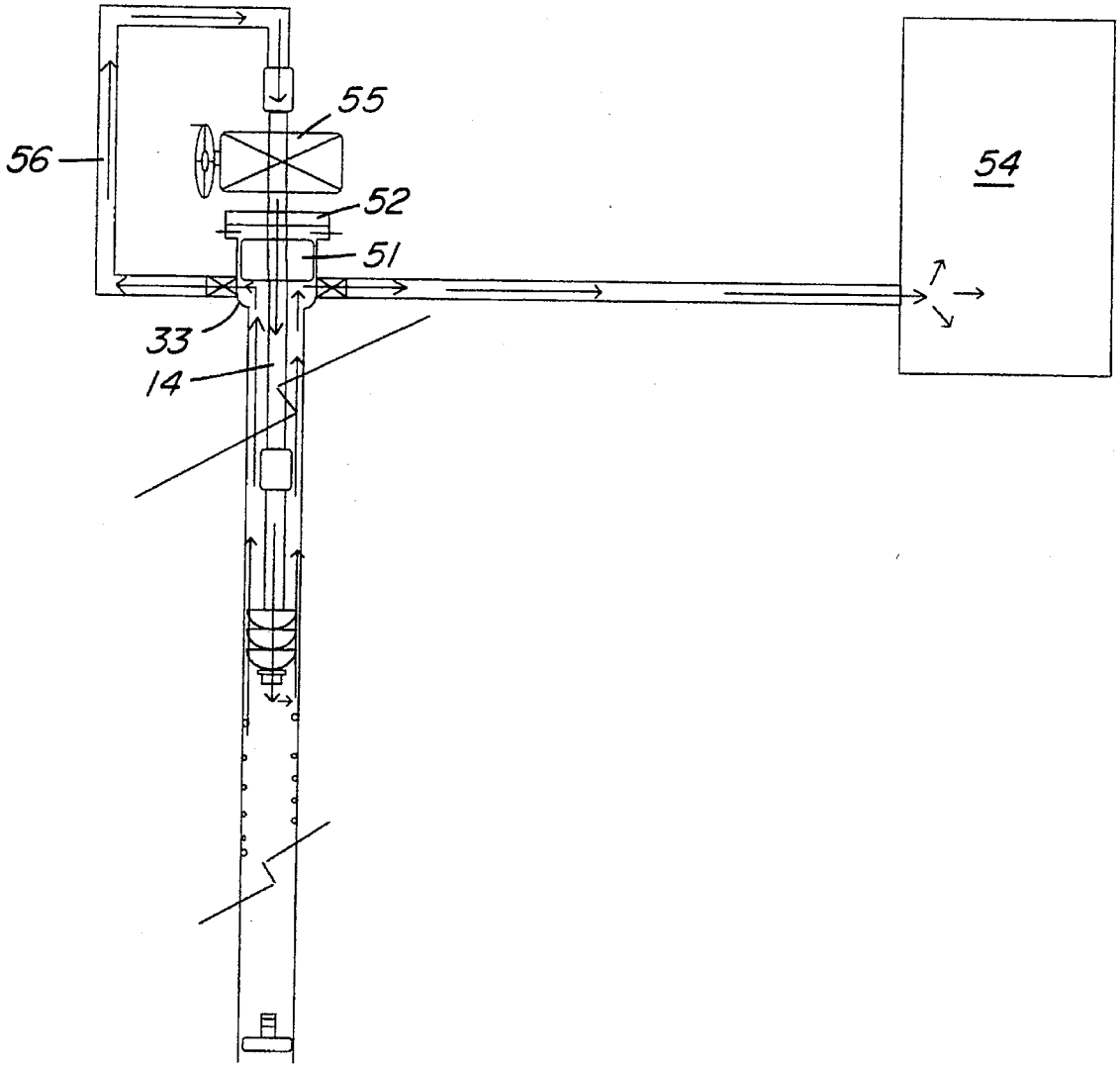

A tubing hanger 51 is then landed using conventional live well lubricating procedures, the blow-out preventers 30 and 31 and the snubbing slips 22 are removed, and a bonnet 52 and master valve 55 (FIG. 6) are installed. An equalizing duct 56 is hooked up to the tubing 14 and the casing 11, and the tubing pressure is equalized to that of the well bore pressure. The tubing master valve 55 is then closed, and flow from the casing 11 to the tank 54 creates a differential pressure and releases the gauge ring 50 and parts of the piston cup assembly 20 from the tubing 14, as shown in FIG. 6 and as described in greater detail below.

Figure 7:
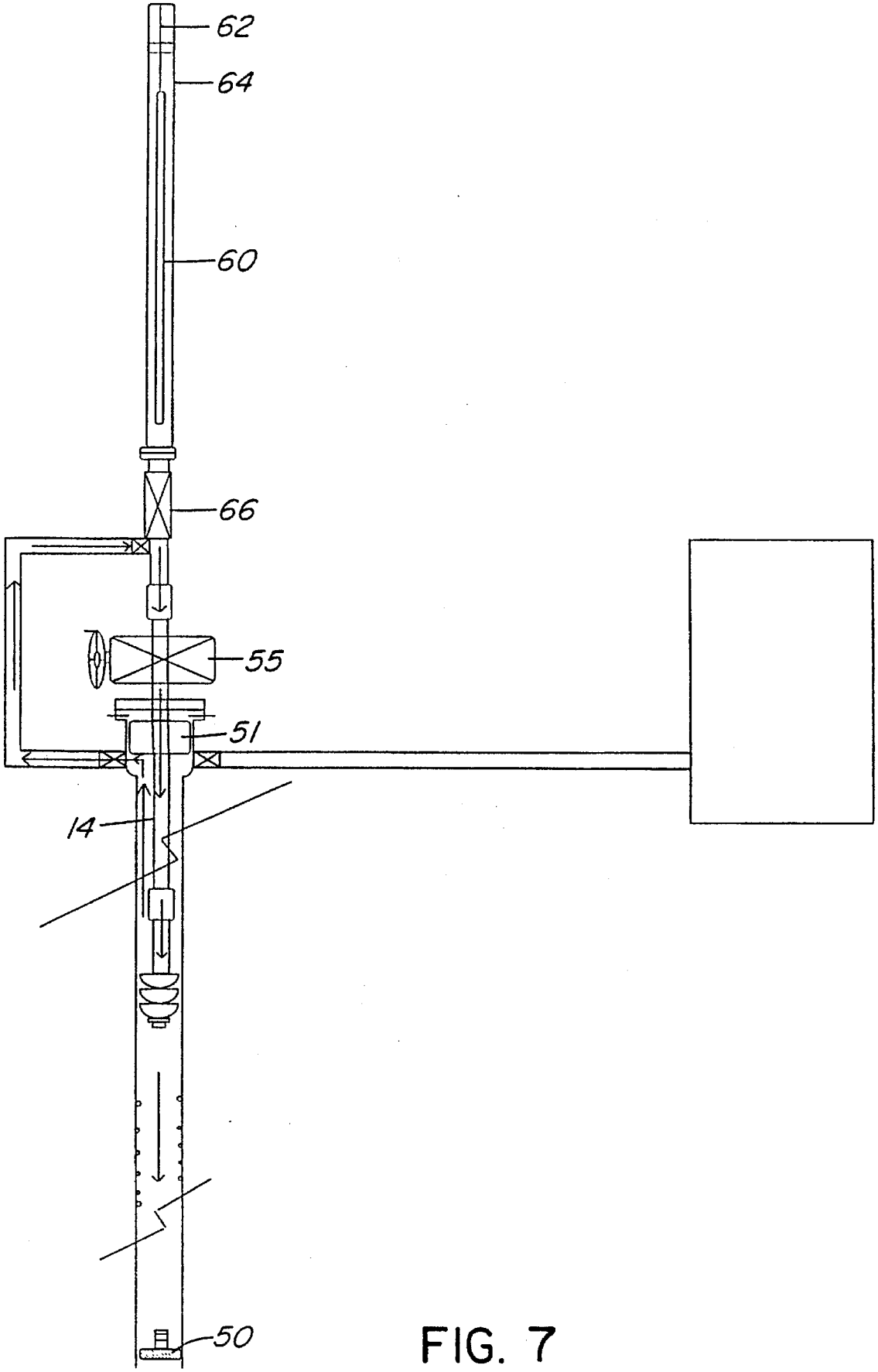

The gauge ring 50 could alternatively be released by making up a sinker bar 60 (FIG. 7) to a sandline 62 and rigging up a lubricator 64 with an orbit valve 66, and then running in and tagging the top of the piston cup assembly 20, equalizing the tubing 14 and the casing 11, and pulling up and lowering down to hit the gauge ring 50 with enough impact to shear off the gauge ring 50 and to cause it to fall to the bottom of the well bore 10.

The fluid pumped by the pump 49 from the reservoir may be water or any other suitable fluid. For example, it could be nitrogen or natural gas or even air, although water would be the preferable material because its low cost and ready availability as well as its incompressibility. The only prerequisite for the pumped fluid would be that its hydrostatic pressure, once the tubing has been injected to its pipe heavy position, would be less than that of the well pressure, allowing the well pressure to displace the fluid back to the tank at surface. Air would not be a good fluid because of the possibility of down hole explosions or fires but may have its place in well applications other than gas or oil wells. Nitrogen would be desirable because it is being an inert gas.

The above-described method has the advantage that the cost of the equipment required for this method is substantially less than the current costs of conventional snubbing equipment, and also that the method can be performed easily by a single person, instead of two, thus reducing labour costs. Any person with experience on a well service rig can easily be trained to perform the present method.

Also, the present method has the advantage of providing total control over the well and of the movement of the tubing. The tubing only moves as the fluid is injected above the piston cup assembly 20. There is a much reduced chance of human error or mechanical failure, and the producing zone in the well is not penetrated by the pumped fluid, which can be totally recovered and reused. The risk of injury is substantially reduced, since all of the operations of the present method can be controlled from a location remote from the well head.

The piston cup assembly 20 will now be described in greater detail with reference to FIGS. 8 through 11 of the drawings.

Referring firstly to FIG. 8, the piston cup assembly 20 has resilient piston cups 72, which are mounted on a hollow shaft 74.

The gauge ring 50 comprises a frusto-conical body 76 having, at the top thereof, an upwardly extending projection forming a cylindrical plug 78 which is slidably received into the lower end of the shaft 74. The plug 78 is provided with two sealing rings 82 of elastermeric material, which form a seal between the plug 78 and the hollow shaft 74. The plug 78 is retained in the lower end of the shaft 74 by means of a shear pin 83, which extends through the shaft 74 and the plug 78.

The frusto-conical shape of the body 76 is downwardly convergently tapered to facilitate passage of the gauge ring 50 downwardly through the casing bowl 32.

The cylindrical body 76 of the gauge ring 50 is formed with four vertically extending through-openings 84, extending from the top to the bottom thereof, to allow fluid to flow through the gauge ring 50 as the piston cup assembly 20 moves along the well bore 10.

The gauge ring 50, which has a diameter slightly less than that of the well bore casing 11, serves to protect the piston cups 72 from any foreign objects within the casing 11, e.g. from any cement stringers which may be left inside the casing 11 when the casing is cemented into place.

When a sufficient differential pressure is created between the interior of the tubing 14 and the well bore 10 as described above with reference to FIG. 6, and since the interior of the hollow shaft 74 communicates with that of the tubing 14, the plug 78 is forced from the end of the hollow shaft 74, thus shearing the pin 83. The gauge pin 50 is then free to fall down the well bore 10.

Figure 11:
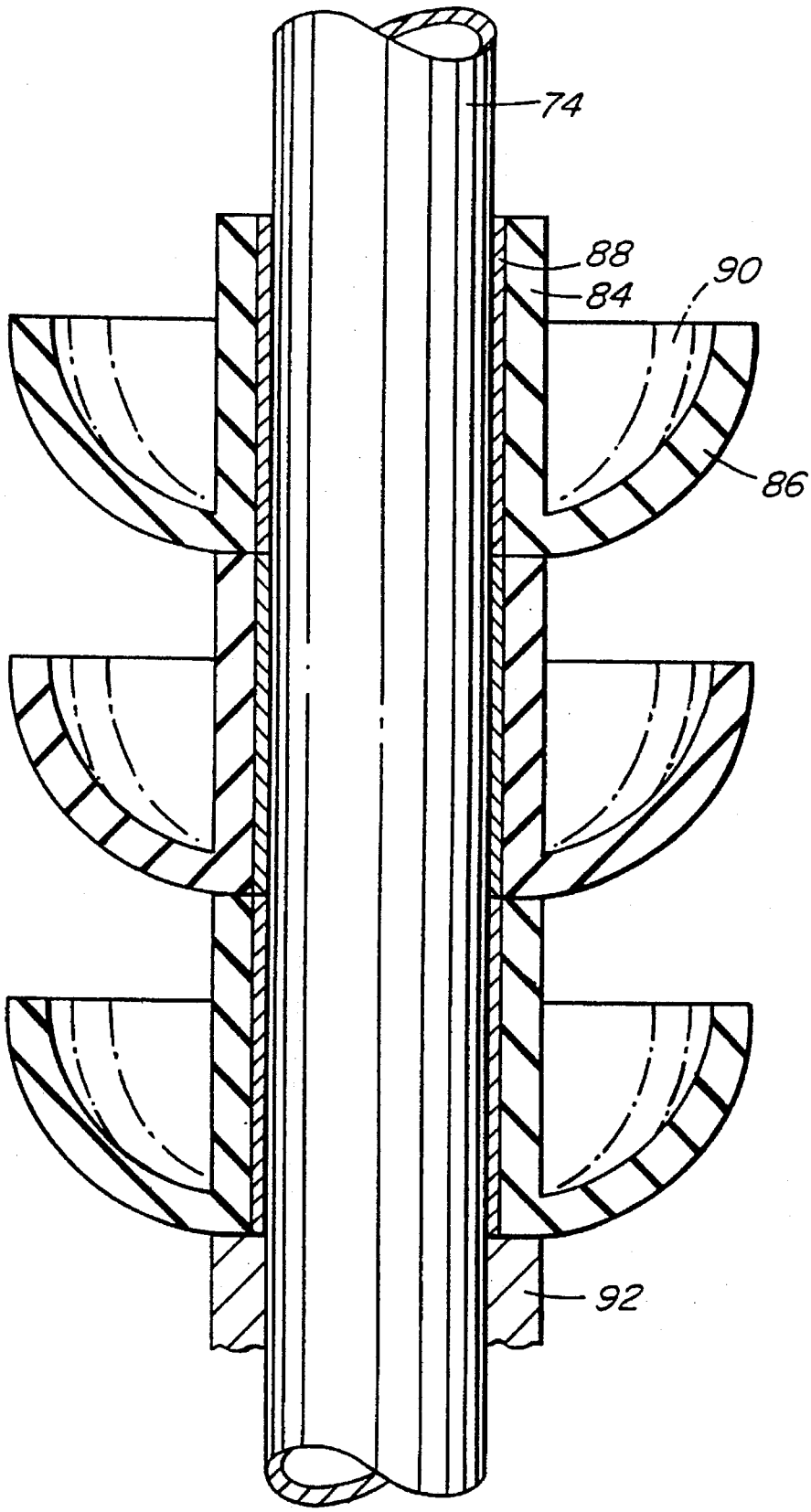
FIG. 11 shows a broken-away view in longitudinal section through part of the piston cup assembly of FIG. 8.

As shown in FIG. 11, the resilient piston cups 72 are each formed with a cylindrical inner portion 84 and an upwardly and outwardly curved, resilient, cup-shaped, laterally projecting portion 86 extending from the lower end of the respective inner portion 84. The inner portions 84 and the laterally outwardly extending portions 86 of the piston cups 72 are formed in one piece of elastomeric material. Each inner portion 84 is bonded to a metal sleeve 88, which fits snugly onto the shaft 74. The inner portion 84 and its sleeve 88 project upwardly beyond the laterally projecting portion 86, so that the superimposed piston cups 72 abut one another with the laterally extending portions 86 spaced apart from one another longitudinally of the shaft 74.

The diameters of the laterally projecting portions 86 are greater than that of the casing 11. Consequently, as the piston cup assembly 20 moves downwardly past the casing cup 32 into the well bore 10, i.e. into the position in which it is shown in FIG. 2, the laterally projecting portions 86 of the piston cups 72 are radially inwardly compressed, into the positions shown by dash-dot lines and indicated by reference numeral 90 in FIG. 11, by sliding engagement with the well bore casing 11. During the above-described insertion of the tubing 14 into the well bore 10, and as the fluid from the well bore 10 flow upwardly past the piston cup assembly 20, the laterally projecting portions 86 of the piston cups 72 are deflected even further radially inwardly of the shaft 74 to allow the fluid to pass upwardly past the peripheries of the laterally projecting portions 86.

Beneath the lowermost piston cup 72, a spacer sleeve 92 abuts a ring 95 (FIG. 8) welded to the shaft 72 and thereby spaces the lowermost piston cup 72 from the ring 95. The piston cups 72 are retained on the shaft 74 by a coupling 96, which is in threaded engagement with the top of the shaft 74 and with the lower end of the tubing 14 for connecting the piston cup assembly 20 to the tubing 14.

Figure 12:
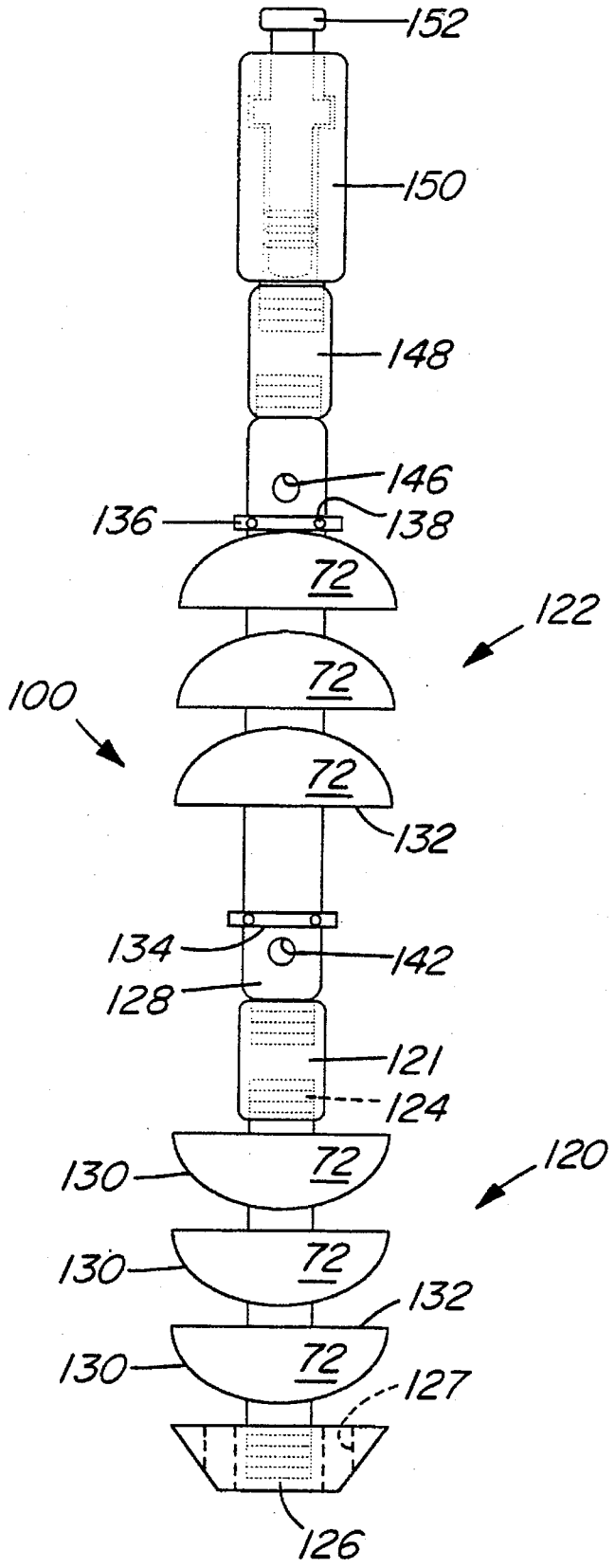
FIG. 12 shows a view in side elevation of a modified, double-acting piston cup assembly.

FIG. 12 shows a double-acting piston cup assembly, indicated generally by reference numeral 100, which may be employed in place of the piston cup assembly 20 of FIGS. 8 through 11.

The piston cup assembly 100 of FIG. 12 comprises a first piston in the form of a piston cup assembly indicated generally by reference numeral 120, connected by a coupling 121 to a further piston in the form of a piston cup assembly indicated generally by reference numeral 122. The piston cup assembly 120 has a length of hollow shaft 124 in threaded engagement with a cylindrical gauge ring 126, at the bottom of the shaft, the gauge ring 126 being formed with through openings 127, extending from top to bottom thereof. Above the gauge ring 127, the shaft 124 carries a first set of three of the resilient piston cups 72, which are retained in abutment with one another between the gauge ring 126 and the coupling 121.

The piston cup assembly 122 comprises an elongate hollow cylindrical housing 128, which is in threaded engagement with the coupling 121 at the lower end of the housing 128. The housing 128 carries a second set of three resilient piston cups 72, which are inverted relative to the piston cups 72 of the lower piston sub-assembly 120. More particularly, the piston cups 72 of the piston cup assembly 120 have upwardly directed concave sides 132, which face concave sides 132 of the resilient piston cup 72 of the upper piston sub-assembly 122 and also have downwardly directed convex sides 130. The lowermost resilient piston cup 72 on the housing 128 abuts an abutment ring 134, on the housing 128, and the uppermost resilient piston cup 72 on the housing 128 is retained by a retainer ring 136, which is secured to the housing 128 by retaining screws 138 extending through the ring 136 into threaded engagement with the housing 128.

An elongate valve member 139 (FIGS. 13 and 14) is slidable to and fro along the hollow interior of the housing 128, to which it is sealed by O-rings 141 and 143. The valve member has a longitudinal recess 140.

Figure 13:
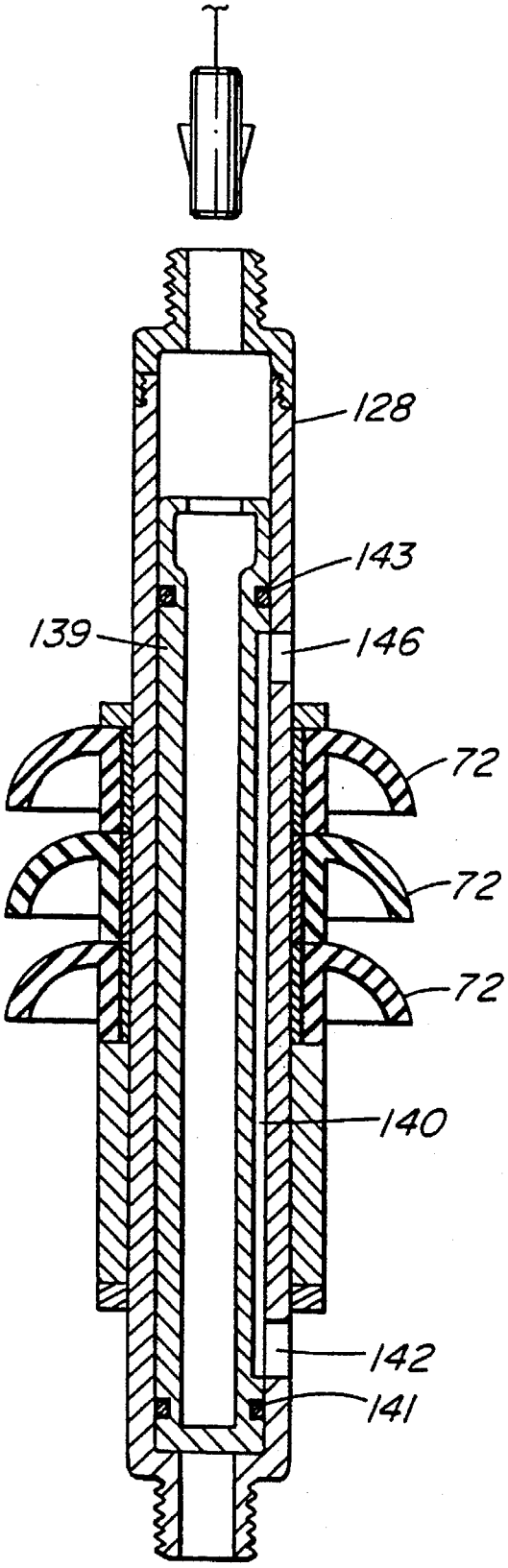
FIGS. 13 and 14 show views taken in vertical cross-section through parts of the piston cup assembly of FIG. 12.

In its lowermost position, in which the valve member 139 is shown in FIG. 13, the recess 140 communicates with the radial openings 142 and 146 in the wall of the cylindrical housing 128, thus providing a path of flow through the housing 128 past the piston cups 72 of the upper piston sub-assembly 122.

Figure 14:
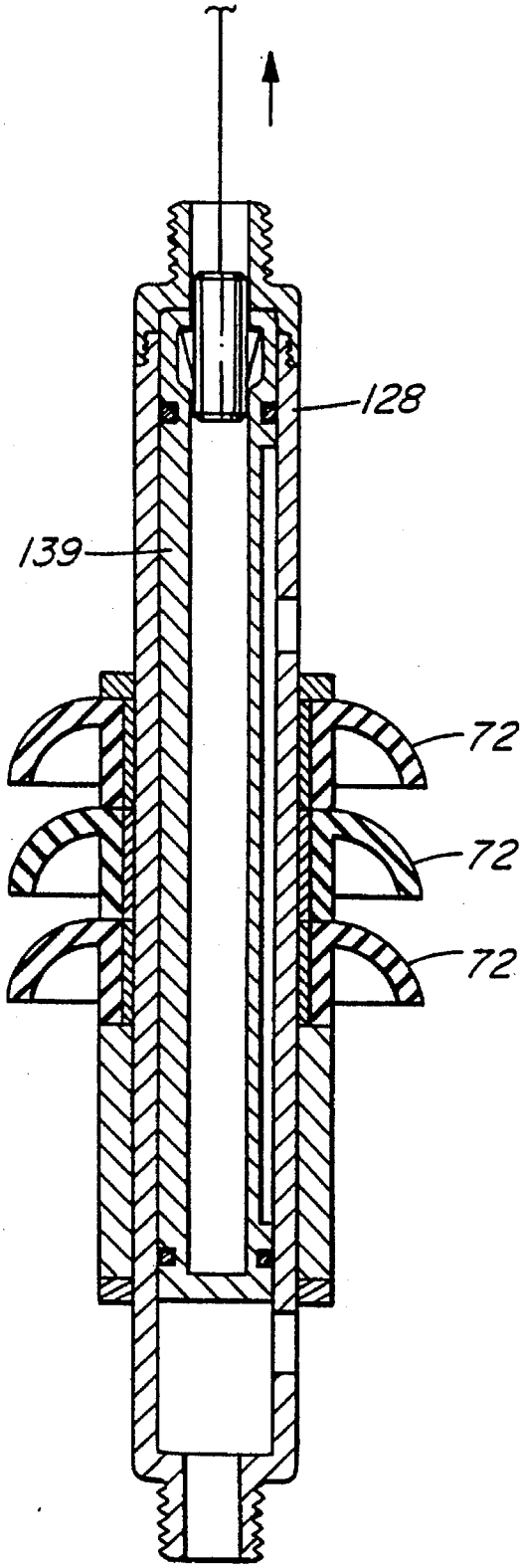

In its raised position, in which the valve member 139 is shown in FIG. 14, the recess 140 no longer communicates with the radial opening 142. Consequently, fluid can no longer flow through the housing 128 past the upper piston sub-assembly 122.

The valve member 139 can be displaced between its uppermost and lowermost positions in the housing 128 by means of a wireline shifting tool 145, which is suspended from a wireline 147 and which has radially retractable dogs 149 for engaging the valve member 139. To receive the tool 145, the valve member 139 if formed at its upper end with an opening 151, which is dimensioned to allow the tool 145 to be lowered through the opneing 151 with the dogs 149 retracted. After the tool 145 has thus been inserted into the valve member 139, the dogs 149 are projected outwardly from the tool 145 by springs (not shown) and engage beneath the top of the valve member 139 adjacent the edge of the opening 151 for raising the valve member 139.

The upper end of the housing 128 is connected by a coupling 148 to a profiled polished bore nipple 150, and a wire line plug 152 projects upwardly from the bore nipple 150, as shown in FIG. 12.

In use, the double-acting piston cup assembly 100 of FIG. 12 is employed for inserting the tubing 14 into the well bore 10 in the same manner as the piston cup assembly 20. However, the double acting piston cup assembly 100 may additionally be employed to pull the tubing from the well.

For this purpose, the wire line plug 152 is installed downhole into the profiled nipple 150 as illustrated in FIG. 12 in a manner known in the art. The pressure in the tubing 14 is then bled off, and the bonnet 52 and the master valve 55 (FIG. 6) are removed from the well head.

The well head equipment 12 (FIG. 1) is then reinstalled on the well head, and the tubing 14 is connected to the elevator 16. The annular blowout preventer is then closed, and the pressure is equalized from below to the top of the tubing hanger 51. The tubing hangers is then pulled up to the bottom of the annular blowout preventer 30, and the pipe rams 36 are closed around the tubing. The valve member 139 is moved up to its closed position in which it closes the flow path through the shaft 128, and pressure above the pipe rams 36 is then bled off, and the annular blowout preventer 30 is opened, so that the tubing hanger can be pulled up above the annular blowout preventer 30, which is then closed. The pressure between the pipe rams 36 and the blowout preventer 30 is then equalized with the well bore pressure, and the pipe rams 36 are opened to allow the tubing hanger 51 to be removed and to allow a coupling (not shown) to be installed.

The tubing 14 is then pulled out of the well to a calculated position, at which the well pressure slightly over-balances the weight of the tubing and is therefore sufficient to move the tubing 14 upwardly in the well bore. If necessary, the snubbing slips 22 may be closed to retain the tubing 14. The casing 35 is fitted with fluid and bled off at a controlled rate, which determines the rate at which the tubing 14 is raised. The fluid in the passage 43 is allowed to travel back to the reservoir tank 54.

Figure 15:
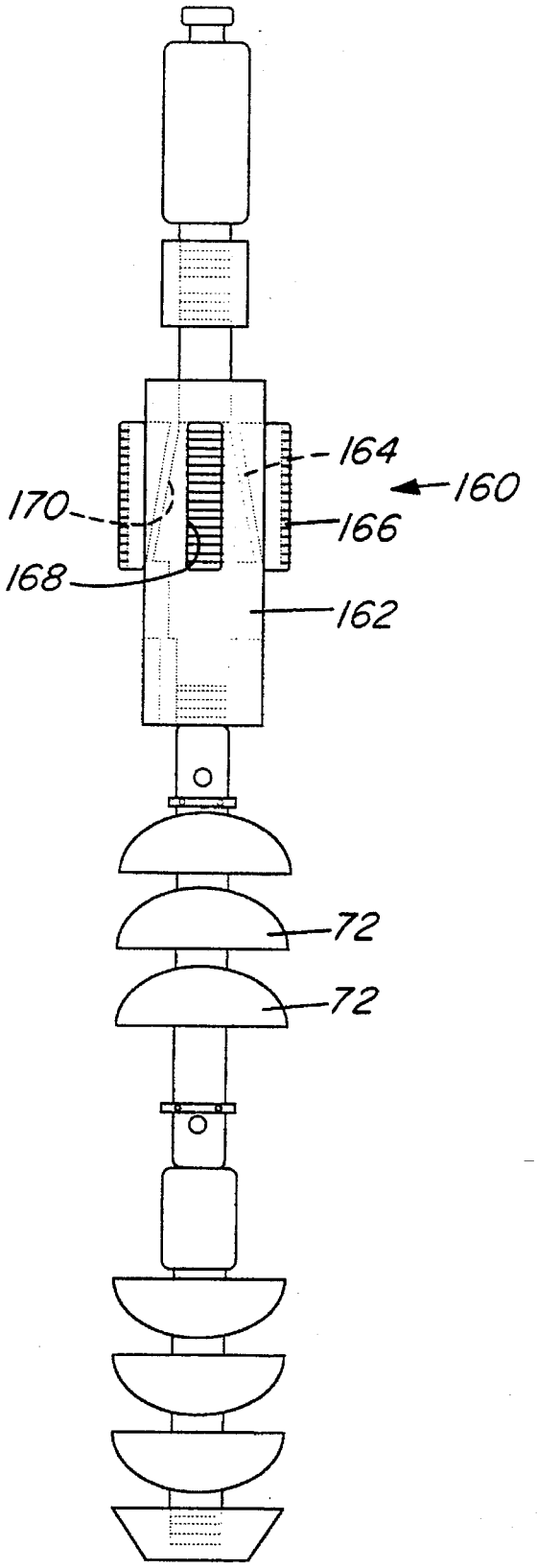
FIG. 15 shows a view in side elevation of a modification of the piston cup assembly of FIG. 12.
Figure 16:
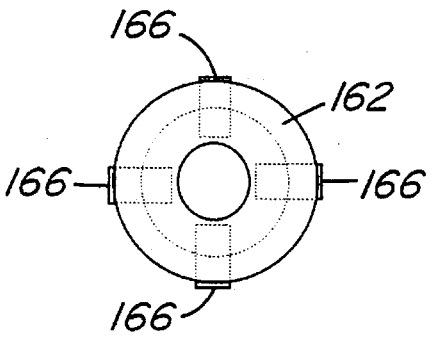
FIG. 16 shows a plan view of parts of the piston cup assembly of FIG. 13.

FIG. 15 shows a modification of double-acting piston of FIG. 12. In the modification shown in FIG. 15, a retractable slip assembly indicated generally by reference numeral 160 is provided above the upper set of piston cups 72, which in this embodiment comprise only two piston cups 72.

The slip assembly 160 comprises a sleeve 162, which is slidable up and down on a frusto-conical wedge member 164 located within the sleeve 162. Four elongate slips 166 are provided in slots 168 in the sleeve 162 and have inner wedge surfaces 170 in sliding engagement with the frusto-conical wedge member 164. The arrangement is such that, on displacement of the wedge member 164 upwardly relative to the sleeve 162, the slips 166 are urged outwardly of the sleeve 162 into gripping engagement with the well bore casing 65.

The slip assembly 160 is useful to prevent buckling of the tubing in the well bore in cases where the well pressure is high and the casing size is large.

For that purpose, the differential pressure across the two uppermost cups 72 displaces the wedge member 164 upwardly in the sleeve 162, to urge the slips 166 radially outwardly against the well bore casing 11.

The well head casing 35 is then bled off, and the casing 35 is supplied with fluid to equalize the pressure, which causes a downwardly acting pressure on the lower most three cups 72 to move the wedge member 164 downwardly and, thus, to allow the slips 166 to retract radially inwardly.

I claim:

1. A method of inserting tubing into a live well bore, comprising the steps of:

attaching a resilient piston to a lower end of said tubing;

lowering said piston into a passage at a well head to locate said piston in a position above a closure which prevents the escape of fluid from the well bore through the passage;

sealing said passage around said tubing above said piston;

opening a path of communication between the well bore below said closure and a portion of said passage above said piston to equalize the hydraulic pressure above said piston with that below said closure;

opening said closure; and pumping fluid from a fluid reservoir into said passage above said piston to force said piston and said tubing downwardly in said well bore; and subsequently allowing said piston and said tubing to descend under gravity while fluid flows upwardly in said well bore past said piston by deformation of said piston by the pressure of said fluid.

2. A method as claimed in claim 1, which includes forcing said piston downwardly past said closure upon the opening of said closure and before the pumping of fluid into said passage.

3. A method as claimed in claim 1, which includes bleeding gas from said passage during the pumping of fluid into said passage.

4. A method as claimed in claim 1, which includes gripping said tubing prior to the pumping of the fluid and wherein the step of pumping fluid into said passage includes increasing the pressure above said piston to a predetermined value and then releasing the gripping of said tubing to allow said piston and therewith said tubing to travel downwardly in the well bore.

5. A method as claimed in claim 1, which includes lowering said piston to a desired location in the well bore, at which the tubing weight is sufficient to overcome the well bore pressure beneath said piston, gripping and retaining said tubing, releasing pressure from above said piston, before the step of allowing said piston and said tubing to descend under gravity.

6. A method as claimed in claim 1, which includes releasibly securing a gauge to a lower end of said piston before inserting said piston into said well bore and releasing said gauge ring from said piston after the insertion of said piston into said well bore.

7. A method as claimed in claim 1, which includes gripping said tubing in snubbing slips prior to the opening of said closure, moving said snubbing slips downwardly to force said piston downwardly into said well bore after the opening of said closure and before the pumping of the fluid from said reservoir into said passage above said piston.

8. A method as claimed in claim 7, which includes gripping said tubing prior to the pumping of the fluid and wherein the step of pumping fluid into said passage includes increasing the pressure above said piston to a predetermined value and then releasing the gripping of said tubing to allow said piston and therewith said tubing to travel downwardly in the well bore.

9. A method as claimed in claim 1, which includes providing an inverted resilient piston at said lower end of said tubing, closing a flow path extending downwardly past said inverted piston to said first mentioned piston and allowing the pumped fluid to flow past said inverted resilient piston by deformation by the pressure of the pumped fluid during the insertion of said tubing into said well bore, and subsequently opening said flow path and pumping fluid downwardly through said flow path to below said inverted resilient piston so as to cause said tubing to be raised in said well bore by pressure of the pumped fluid acting upwardly on said inverted resilient piston.

* * * * *